US011254152B2

(12) United States Patent
Deljou

(10) Patent No.: US 11,254,152 B2
(45) Date of Patent: Feb. 22, 2022

(54) PRINTED FRAME IMAGE ON ARTWORK

(71) Applicant: Kamran Deljou, Atlanta, GA (US)

(72) Inventor: Kamran Deljou, Atlanta, GA (US)

( * ) Notice: Subject to any disclaimer, the term of this patent is extended or adjusted under 35 U.S.C. 154(b) by 0 days.

(21) Appl. No.: 16/122,260

(22) Filed: Sep. 5, 2018

(65) Prior Publication Data

US 2019/0084326 A1 Mar. 21, 2019

Related U.S. Application Data

(60) Provisional application No. 62/559,092, filed on Sep. 15, 2017.

(51) Int. Cl.

| | |
|---|---|
| ***B41J 29/38*** | (2006.01) |
| ***A47G 1/06*** | (2006.01) |
| ***B44F 11/02*** | (2006.01) |

(52) U.S. Cl.

CPC ..... *B41J 29/38* (2013.01); *A47G 1/06* (2013.01); *B44F 11/02* (2013.01)

(58) Field of Classification Search

USPC ..... 324/101; 347/101

See application file for complete search history.

(56) References Cited

U.S. PATENT DOCUMENTS 3,070,914 A 1/1963 Henderson et al.
4,939,858 A 7/1990 Dailey
5,469,536 A * 11/1995 Blank ..... H04N 1/3873 345/594
5,477,264 A * 12/1995 Sarbadhikari ..... G06F 8/65 348/231.6
5,508,103 A 4/1996 Cope (Continued)

OTHER PUBLICATIONS

Imageframer, https://apps.apple.com/us/app/imageframer/id461733187?mt=12, Jul. 22, 2017 in view of Ito (US 2008/0246757). (Year: 2017).*

(Continued)

*Primary Examiner* — Rodney E Fuller

(74) *Attorney, Agent, or Firm* — Bryan W. Bockhop; Bockhop Intellectual Property Law, LLC

(57) ABSTRACT

In a method of generating a print, an image of at least one work of art is scanned, thereby generating an artwork digital image. An image of at least one frame molding is scanned, thereby generating a molding digital image. An image of at least one matte is scanned, thereby generating a matte digital image. The artwork digital image, either scanned, imported or sourced from elsewhere, is combined with the molding digital image, and/or mat digital image, either scanned, imported, or sourced from elsewhere, thereby generating a combined image of the work of art surrounded by a frame made of the molding and/or matte. The combined image is printed onto a substrate. A system for generating printed artwork includes a scanner that is configured to scan works of art, mattes and moldings. A computer combines a digital artwork image with a digital molding and/or matte image, thereby generating a combined digital image that include an image of one of the works of art surrounded by an image of a frame made from one or multiple moldings and/or mattes. A printer prints the combined digital image onto a selected substrate.

18 Claims, 5 Drawing Sheets

(56) References Cited

U.S. PATENT DOCUMENTS 5,577,179 A * 11/1996 Blank ..... H04N 1/3873 345/639
5,594,850 A * 1/1997 Noyama ..... G06T 15/405 345/632
5,631,983 A * 5/1997 Ohnishi ..... G06T 11/001 358/450
5,695,346 A 12/1997 Sekiguchi et al.
5,914,748 A * 6/1999 Parulski ..... H04N 5/272 348/239
6,822,756 B1 * 11/2004 Cok ..... H04N 1/3872 358/1.9
6,912,311 B2 * 6/2005 Anderson ..... G06T 11/60 358/1.11
7,000,192 B2 * 2/2006 Allen ..... G06T 11/001 382/165
7,330,195 B2 * 2/2008 Li ..... H04N 1/3871 345/629
7,973,796 B1 * 7/2011 Marston ..... G06T 11/60 345/581
8,204,272 B2 * 6/2012 Marks ..... H04N 5/2226 345/84
8,422,794 B2 * 4/2013 Ptucha ..... G06F 16/583 382/209
9,681,041 B1 * 6/2017 Swatko ..... H04N 1/00411
2004/0207705 A1 * 10/2004 Ozawa ..... B41J 2/01 347/101
2005/0146537 A1 * 7/2005 Yamakado ..... G06T 11/60 345/629
2006/0172120 A1 * 8/2006 Longobardi ..... B44D 2/005 428/156
2007/0067179 A1 * 3/2007 Kerr ..... G06Q 30/0283 705/16
2007/0154635 A1 * 7/2007 Leftwich ..... B05D 5/06 427/180
2008/0246757 A1 * 10/2008 Ito ..... H04N 13/305 345/419
2009/0019807 A1 1/2009 Coghlan et al.
2010/0023155 A1 * 1/2010 Conrad ..... B29C 33/3835 700/119
2010/0271365 A1 * 10/2010 Smith ..... G06T 13/40 345/419
2011/0029553 A1 * 2/2011 Bogart ..... G06F 16/58 707/769
2011/0029635 A1 * 2/2011 Shkurko ..... H04N 1/00132 709/217
2012/0027294 A1 * 2/2012 Krolczyk ..... G06T 11/60 382/165
2012/0297653 A1 * 11/2012 Ridless ..... A47G 1/141 40/773
2015/0265072 A1 * 9/2015 Ridless ..... B41M 5/52 40/773

OTHER PUBLICATIONS

Lexjet, https://blog.lexjet.com/2014/07/14/how-to-make-canvas-printing-work-for-you-part-1-materials-finishes-and-textures/, Jul. 14, 2014. (Year: 2014).*
A. FrameShop—A Framing Script for Adobe Photoshop, https://www.joecolsonphotography.com/2011/01/29/frameshop-a-framing-script-for-adobe-photoshop/, Jan. 29, 2011. (Year: 2011).*
Etsy Studio: "Picture Frames Clipart, Digital blue, green, pink molding Clip Art PNG for wedding, part invitation, Instant Download"; https://www.etsystudio.com/listing/239025905/picture-frames-clipart-digital-blue; published no later than Jun. 27, 2017.
Visio: "Frames standard with Visio 2003"; published no later than 2003.

* cited by examiner

PRINTED FRAME IMAGE ON ARTWORK

CROSS-REFERENCE TO RELATED APPLICATION(S)

This application claims the benefit of U.S. Provisional Patent Application Ser. No. 62/559,092, filed Sep. 15, 2017, the entirety of which is hereby incorporated herein by reference.

BACKGROUND OF THE INVENTION

1. Field of the Invention

The present invention relates to art production processes and, more specifically, to a system for adding images of frames to printed artwork.

2. Description of the Related Art

Individuals, businesses, institutions, such as hotels and the like, display art work in their living environments. While some of the artwork is original, much of it includes printed copies of original artwork. Frequently, such artwork is duplicated via printing on canvases or other substrates to give it an original "feel" to multiple copies. The printed artwork is then mounted and framed.

Framing artwork can be quite expensive when many copies are produced. For example, many hotels have over 500 rooms. When a hotel places four prints in each room, over 2,000 prints must be mounted and framed. The resulting cost just for the framing alone can be in the hundreds of thousands of dollars.

In the alternative, some prints are wrapped around a frame (such as a wooden frame or a stretching bar, also known as a backing frame) in what is referred to as a "stretched canvas" and/or a "gallery wrap." In a gallery wrap, part of the print is wrapped around the sides of the frame. However, a gallery wrap does not lend itself well aesthetically to certain genres of prints. For example, many people do not want gallery wrapped prints of renaissance artwork, nature scenes and the like.

Therefore, there is a need for a process for presenting an image of framed artwork without incurring the cost of framing.

SUMMARY OF THE INVENTION

The disadvantages of the prior art are overcome by the present invention which, in one aspect, is a method of generating a print, in which an image of at least one work of art is scanned, thereby generating a digital image of the artwork. An image of at least one frame molding is scanned, thereby generating a digital image of the molding. The artwork digital image is combined with the molding digital image, thereby generating a combined image of the work of art surrounded by a frame made of the molding. The combined image is printed onto a substrate.

In another aspect, the invention is a system for generating printed artwork that includes an art scanner that is configured to multi-dimensionally scan works of art, thereby generating digital artwork images thereof. A molding scanner is configured to multi-dimensionally scan moldings, thereby generating digital molding images thereof. A computer is programmed to combine at least one of the digital artwork images with at least one digital molding image, thereby generating a combined digital image that include an image of one of the works of art surrounded by an image of a frame made from one of the moldings. A printer prints in multiple dimensions the combined digital image onto a selected substrate.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
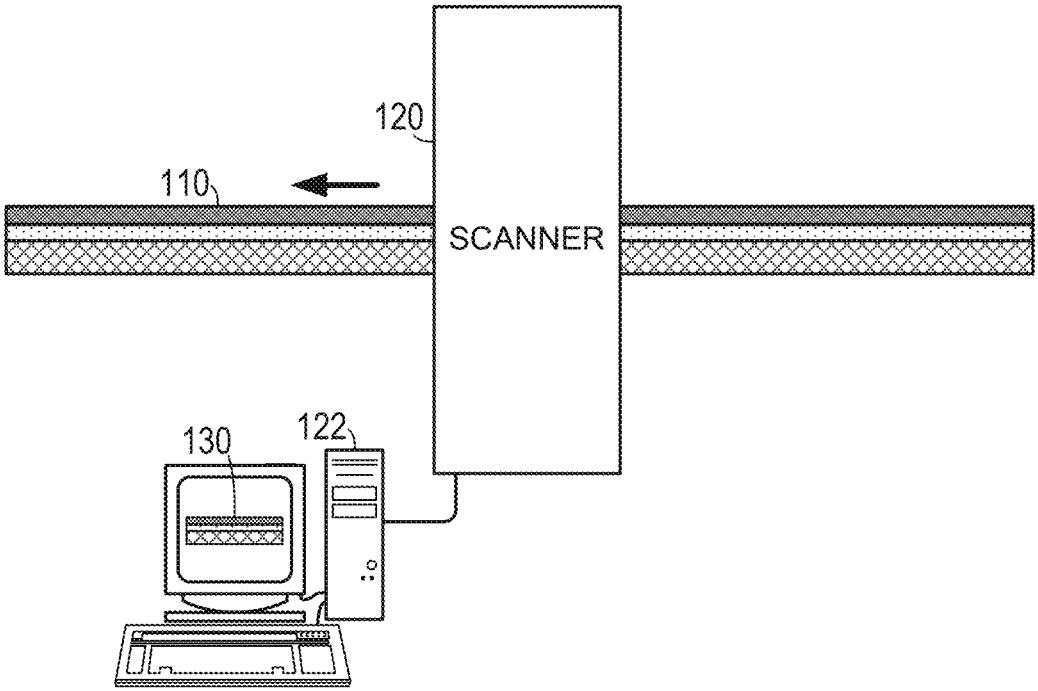
FIG. 1 is a schematic diagram of a molding scanning system.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on." As used herein, "artwork" includes any tangible aesthetic expression of authorship, examples of which include: paintings, drawings, sketches, photographs, prints, sculptural works, etc.

As shown in FIG. 1, in one embodiment of the invention, a scanner 120, which is in data communication with a computer 122 that includes a non-volatile memory and a display device, is used to scan a piece of molding 110 of the type that is typically employed in a picture frame and stores a digital image 130 of the molding 110. The scanner 120 can also scan a matte board, including a beveled matte. In one embodiment, the scanner 120 senses and records two or three dimensional information about the molding 110.

Figure 2:
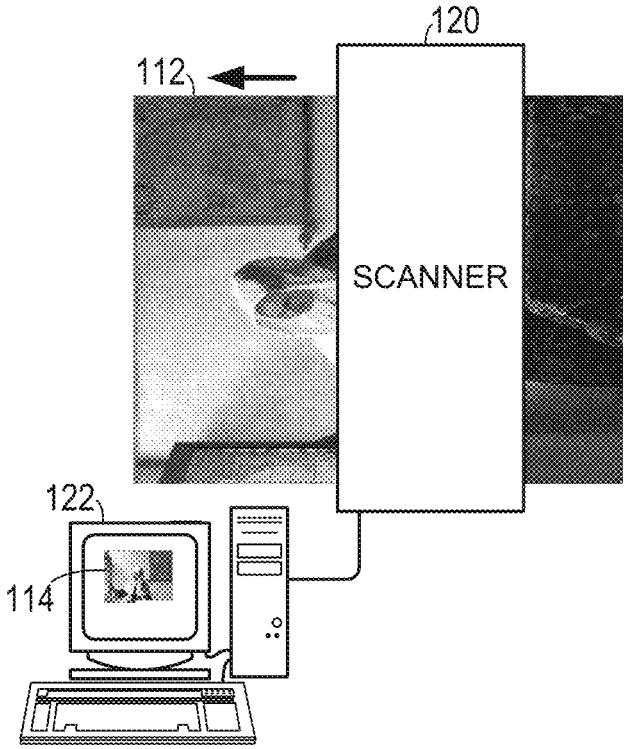
FIG. 2 is a schematic diagram of an artwork scanning system.

As shown in FIG. 2, the scanner 120 also scans at least one original work of art 112 and stores a digital image 114 of the work of art 112. In one embodiment, the scanner 120 can sense and store two- or three-dimensional information about the work of art 112, which would indicate the texture of brush strokes and the like. There is no requirement that the scanner used to scan the molding be the same scanner used to scan the work of art.

Figure 3:
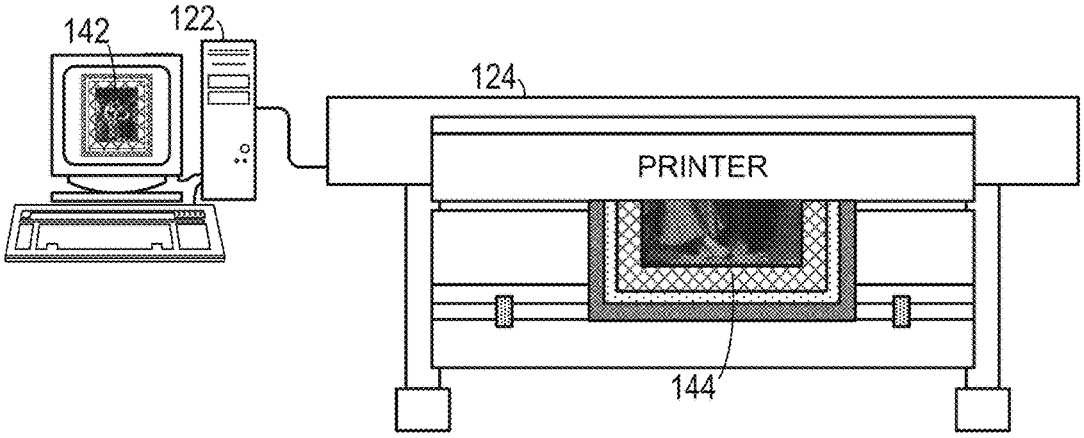
FIG. 3 is a schematic diagram of a combined image printing system.

As shown in FIG. 3, the computer 122 combines the digital image of the artwork with the digital image of the molding (and any matte material that is desired) into a combined image 142. (It should be noted that the digital images need not have been sourced from scanning only.) The combined image is printed onto a substrate with a printer 124 (such as an ink jet printer) to generate an image 144 that appears to be framed. The substrate can be one of many different materials, depending upon the specific application. For example, the substrate could include: a flexible canvas material, a rigid plastic, a flexible plastic, a metal, a wood product, a fiberboard, a glass material, a mirror, etc. If the printer is a three dimensional printer, it can print the frame in relief and can also print the texture of the brush strokes in the art work.

Figure 4A:
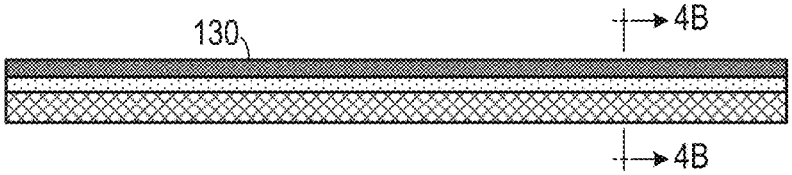
FIGS. 4A-4D are schematic diagrams showing digital images of moldings/mattes being assembled into an image of a frame.
Figure 4B:
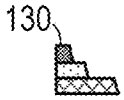
Figure 4C:
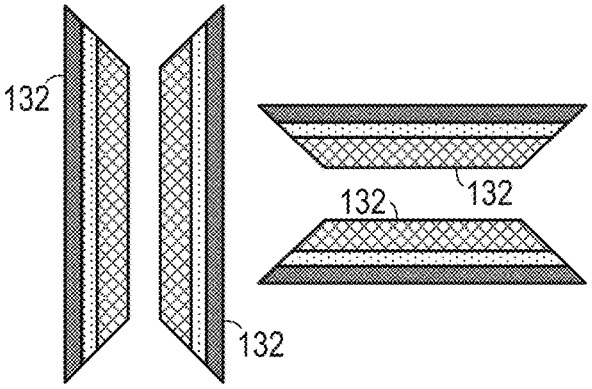
Figure 4D:
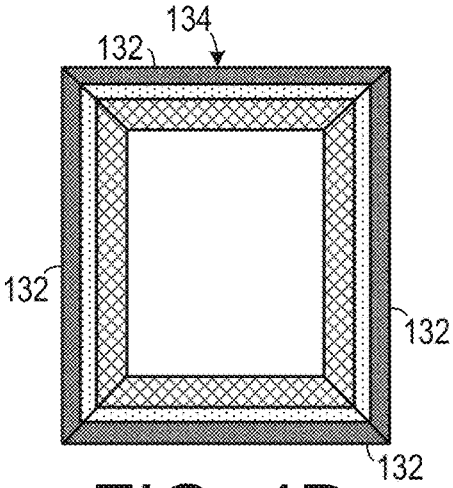

As shown in FIGS. 4A-4D, the scanned molding 130 (which can be a three dimensional image, as shown in FIG. 4B) can be manipulated by the computer to generate a plurality of molding segments 132, each having a length that corresponds to the outer edges of the work of art. The segments 132 are then assembled to form a frame image 134. In certain embodiments, the molding images can be sourced from a non-scanned image source.

Figure 5A:
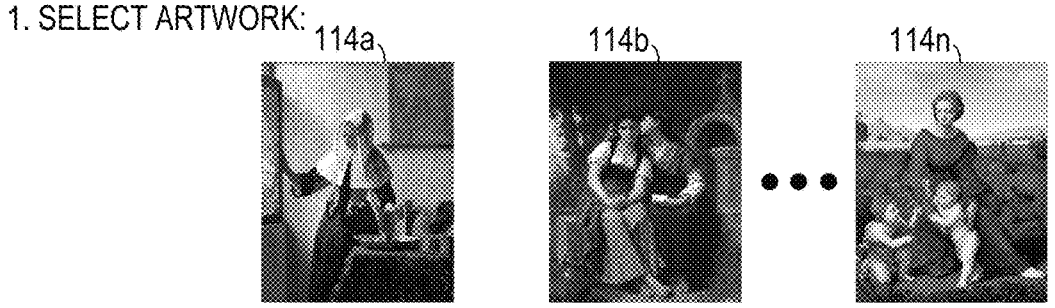
FIGS. 5A-5E are schematic diagrams showing a process of selecting artwork images, moldings/mattes, substrates and combining them onto a final digital file for sale or print.
Figure 5B:
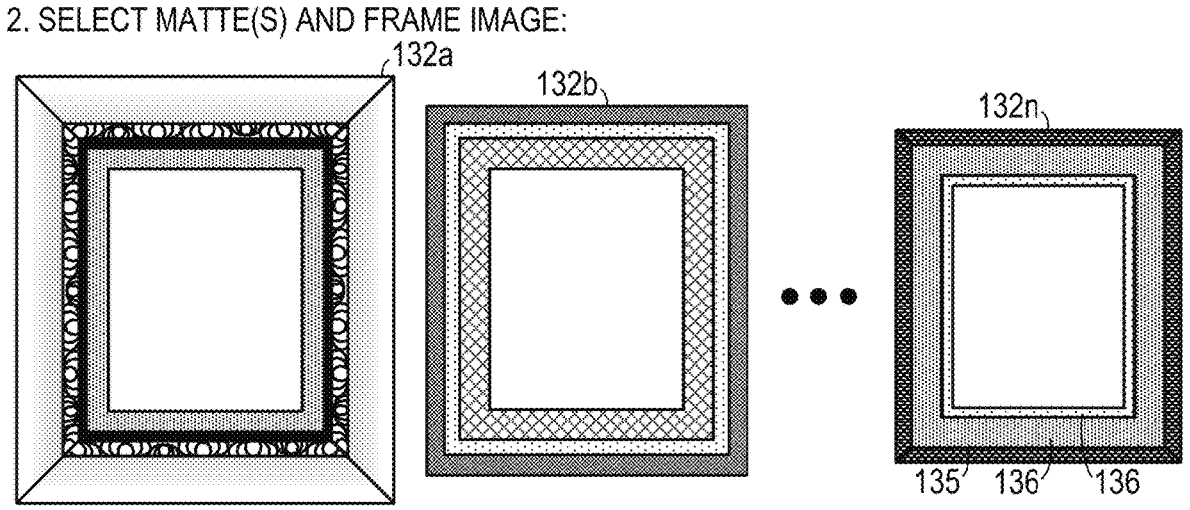
Figure 5C:
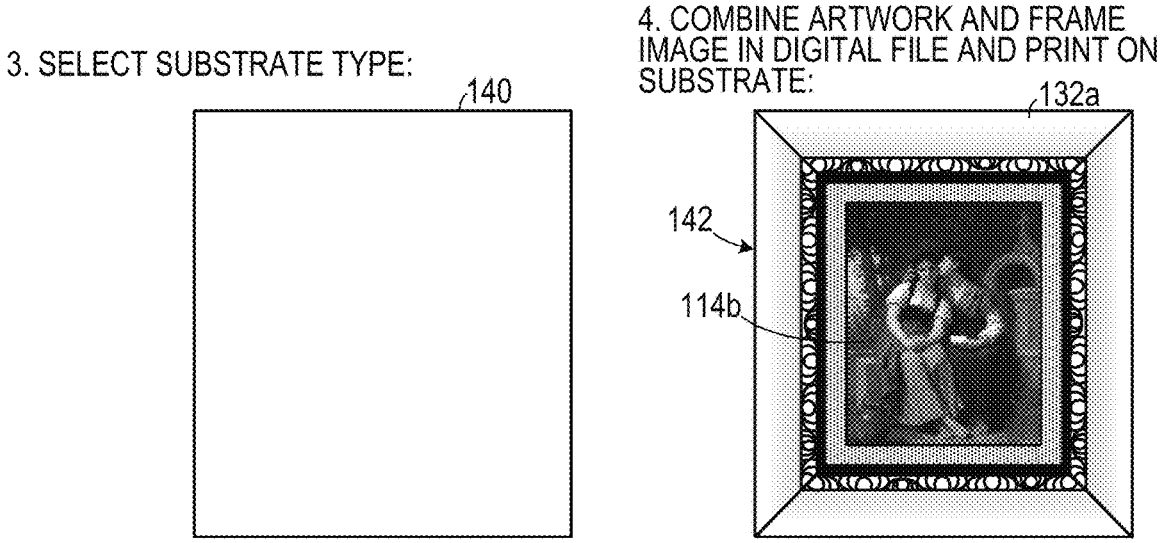

In one practical embodiment, a user selects from several different digital images 114*a-n* of works of art, as shown in FIG. 5A. The user also selects from different frame styles 132*a-n*, as shown in FIG. 5B. The frame style may include the image of at least one molding 135 and one or more matte styles 136 (which can include beveled mattes). As shown in FIG. 5C, the desired substrate type 140 is selected. The selected artwork image 114*b* and the selected frame/matte image 132*a* are printed onto the substrate to generate the print 142.

Figure 5D:
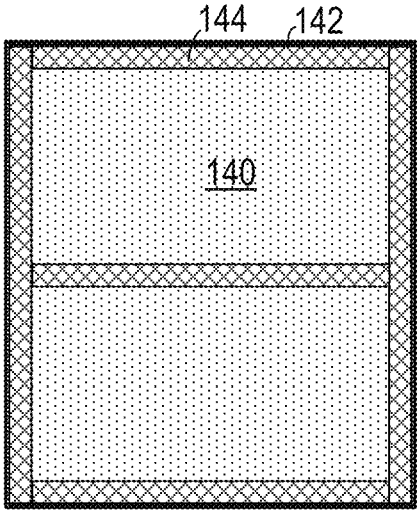
Figure 5E:
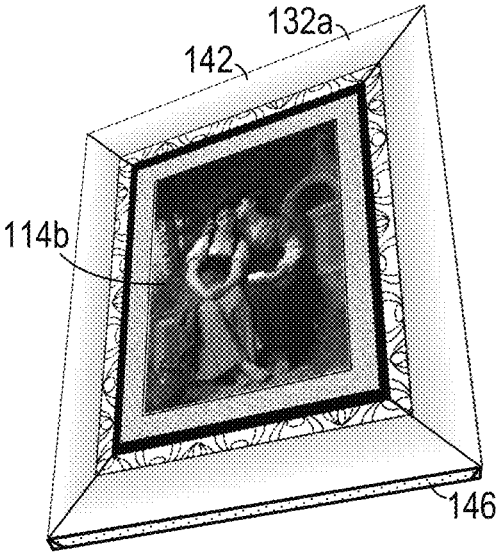

As shown in FIG. 5D, the print 142 can be mounted on a frame 144, such as a wood frame, if the substrate 140 is made of a flexible material. This results in a print 142 that appears to be a framed work of art ready for display, as shown in FIG. 5E.

Figure 6:
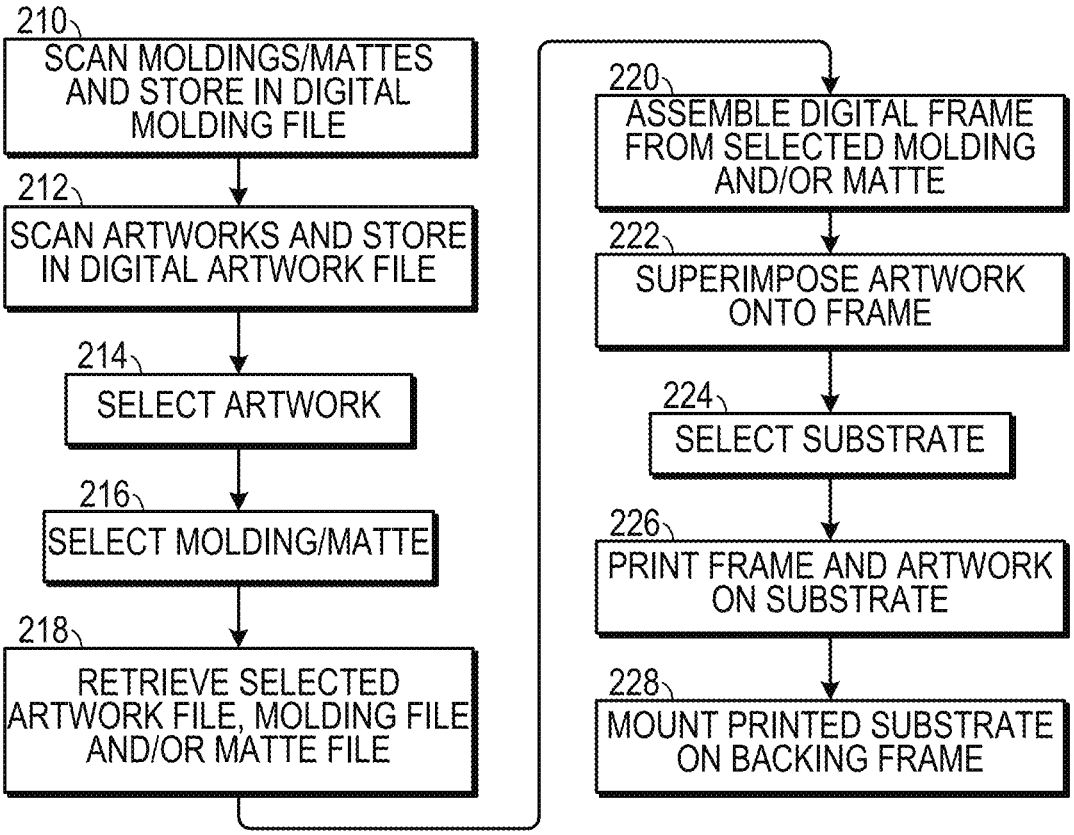
FIG. 6 is a flowchart showing one method of generating prints that include the image of a frame.

As shown in FIG. 6, in one method for generating a framed print, of the type disclosed above, moldings and mattes are scanned and stored in a digital file 210. In certain embodiments, they can be imported, sourced or digitally created. Works of art, such as paintings and the like, are scanned and stored in a digital file 212. The user selects an artwork 214 and a combination of molding and mattes 216. The digital images of the artwork, the molding and mattes are retrieved 218 from memory. The molding and any desired mattes images are assembled to generate an image of a frame 220, which is superimposed onto the image of the artwork 222 and stored in a combined image file. The substrate is selected 224 and the combined image is printed on the substrate 226 resulting in the final print. The final print is then stretched and/or mounted, if necessary, onto a backing frame 228. (It will be understood that when the images are printed on certain substrates, such as rigid substrates, the backing frame may not be necessary.)

Figure 7A:
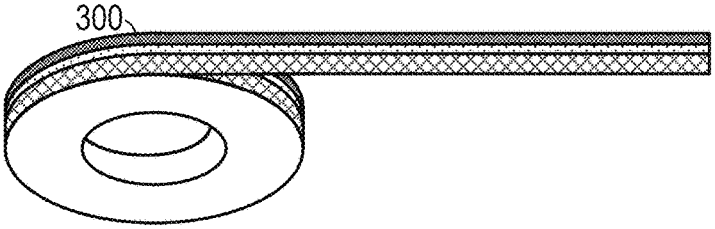
FIGS. 7A-7D are schematic diagrams demonstrating a method of printing a frame image onto any material applied adhesively, such as tape and then applying the material to an artwork, print or original.
Figure 7B:
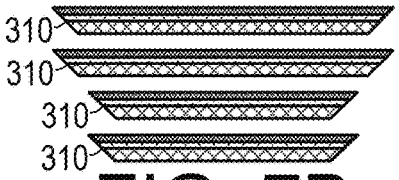
Figure 7C:
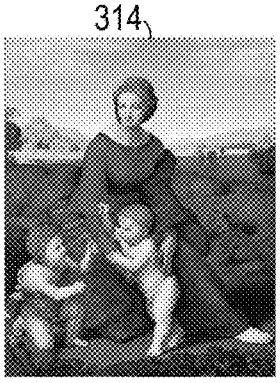
Figure 7D:
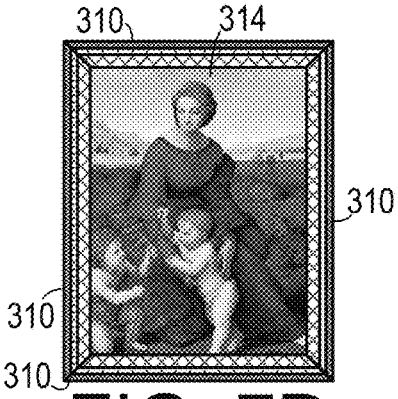

In one embodiment, as shown in FIG. 7A, the moldings and any desired mattes can be printed on a roll of spooled substrate 300. As shown in FIG. 7B, framing segments 310 can be cut from the roll of spooled substrate 300 and applied or affixed to an existing original work or print 314, as shown in FIG. 7C, thereby giving the existing original work or print 314 a framed look, as shown in FIG. 7D. In one embodiment, the molding image may be printed on a tape to which an adhesive (such as a pressure-sensitive adhesive) may subsequently be applied.

Figure 8:
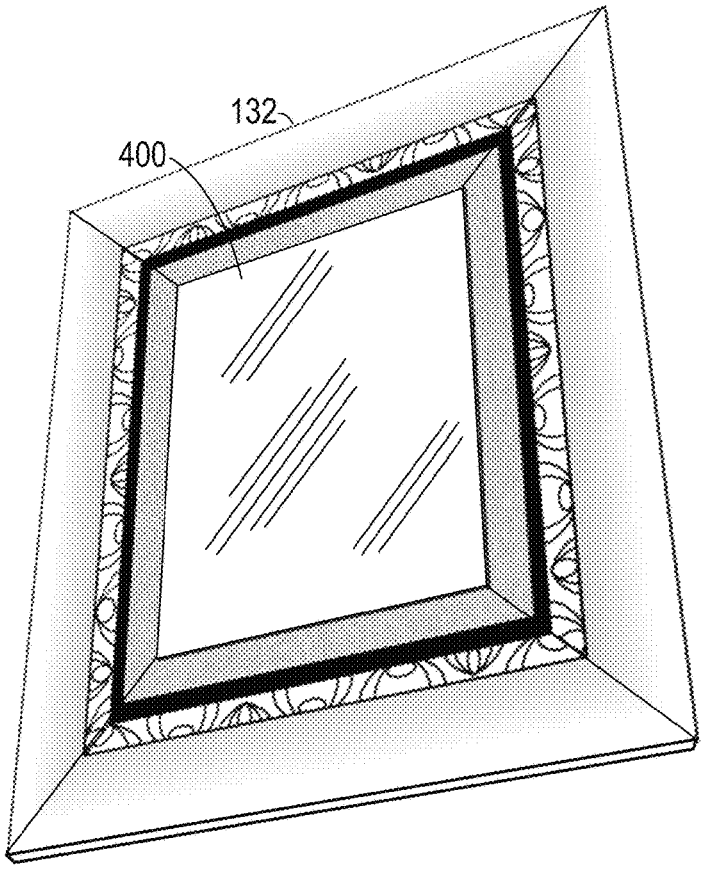
FIG. 8 is a schematic diagram of an embodiment in which a frame image is printed onto a mirror or other reflective surface.

As shown in FIG. 8, in one embodiment, a frame image 132 can be printed on a glossy object, or a reflective surface such as a mirror 400, thereby giving the mirror 400 a framed appearance.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A method of generating a print, comprising the steps of:

(a) scanning at least one work of art, thereby generating an artwork digital image;

(b) scanning with a digital scanner at least one actual physical linear piece of frame molding in a single orientation, thereby generating a single linear molding digital image of the actual physical linear piece of frame molding;

(c) generating a plurality of separate individual molding image segments from the single linear molding digital image, each molding image segment having a length that corresponds to a different outer edge of the artwork digital image;

(d) combining the artwork digital image with the plurality of separate individual molding image segments arranged around the artwork digital image thereby generating a combined image of the work of art surrounded by a frame;

(e) printing the combined image onto a flexible substrate; and (f) mounting the flexible substrate on a backing frame so as to generate a print having an appearance of a framed artwork.

2. The method of claim 1, wherein the step of scanning an image of at least one frame molding includes the step of scanning three dimensional information from the frame molding.

3. The method of claim 1, wherein the step of printing the combined image onto a substrate includes printing in three dimensions with a three dimensional printer.

4. The method of claim 3, wherein the printing step further comprises the step of printing three dimensional relief features of the combined image with the three dimensional printer.

5. The method of claim 4, wherein the step of printing three dimensional relief features comprises the step of printing three dimensional relief features corresponding to the three dimensional information scanned from the frame molding.

6. The method of claim 4, wherein the step of printing three dimensional relief features comprises the step of printing three dimensional relief features corresponding to three dimensional brush stroke information scanned from the work of art.

7. The method of claim 1, further comprising the step of scanning at least one matte, thereby generating a matte digital image, wherein the combining step further comprises combining the matte digital image to the combined image.

8. The method of claim 1, wherein the flexible substrate comprises a canvas material.

9. A system for generating printed artwork, comprising:

(a) an art scanner that is configured to scan at least one work of art, thereby generating a digital artwork image thereof;

(b) a digital molding scanner that is configured to scan an actual physical piece of linear molding in a single orientation, thereby generating a single linear digital molding image thereof;

(c) a computer that is programmed to generate a plurality of molding image segments from the linear digital molding image generated by the molding scanner, wherein each molding image segment has a length that corresponds to a different outer edge of the artwork digital image, and combine the artwork digital image from the art scanner with the plurality of molding image segments arranged around the artwork digital image so as to generate a combined digital image of the work of art surrounded by a frame;

(d) a printer, responsive to the computer, that prints the combined digital image onto a selected substrate; and (e) a backing frame on which the substrate is mounted so the print has an appearance of a framed artwork.

10. The system of claim 9, further comprising a matte scanner that is configured to scan mattes, thereby generating digital matte images thereof, wherein the computer is further programmed to add an image of one or multiple mattes to the combined image.

11. The system of claim 10, wherein at least one of the art scanner, the molding scanner and the matte scanner includes a capability to sense and store information from three dimensions.

12. The system of claim 11, wherein the printer has three dimensional printing ability so that it prints a three dimensional image onto the substrate.

13. The system of claim 12, wherein the computer that is further programmed to cause the printer to print three dimensional relief features onto the substrate.

14. The system of claim 13, wherein the three dimensional relief features correspond to the three dimensional information scanned from the frame molding.

15. The system of claim 13, wherein the three dimensional relief features correspond to three dimensional brush stroke information scanned from the work of art.

16. The system of claim 9, wherein the printer comprises an ink jet printer.

17. The system of claim 9, wherein the substrate comprises at least a selected one of: a flexible canvas material, a rigid plastic, a metal, a wood product, a fiber board, a glass material, a mirror, paper products and a tape.

18. The system of claim 9, further comprising a backing frame that mounts the substrate on which the combined digital image is printed.

* * * * *